US011407144B2

(12) United States Patent
Lenz

(10) Patent No.: US 11,407,144 B2
(45) Date of Patent: Aug. 9, 2022

(54) METHOD AND DEVICE FOR PRODUCING CONCRETE COMPONENTS

(71) Applicant: Tankred Lenz, Dresden (DE)

(72) Inventor: Tankred Lenz, Dresden (DE)

( * ) Notice: Subject to any disclaimer, the term of this patent is extended or adjusted under 35 U.S.C. 154(b) by 366 days.

(21) Appl. No.: 16/312,766

(22) PCT Filed: Jun. 14, 2017

(86) PCT No.: PCT/EP2017/064565
§ 371 (c)(1),
(2) Date: Dec. 21, 2018

(87) PCT Pub. No.: WO2017/220408
PCT Pub. Date: Dec. 28, 2017

(65) Prior Publication Data

US 2019/0160706 A1 May 30, 2019

(30) Foreign Application Priority Data

Jun. 22, 2016 (DE) ..... 10 2016 211 176.0

(51) Int. Cl.
*B28B 23/00* (2006.01)
*B28B 23/04* (2006.01)
(Continued)

(52) U.S. Cl.
CPC ..... *B28B 23/0006* (2013.01); *B28B 23/043* (2013.01); *B28B 23/06* (2013.01);
(Continued)

(58) Field of Classification Search
CPC ... B28B 23/0006; B28B 23/043; B28B 23/06; E04C 5/07; E04C 5/073; E04C 5/085; E04C 5/12; E04G 21/12
See application file for complete search history.

(56) References Cited

U.S. PATENT DOCUMENTS 3,041,702 A 7/1962 Schwab
5,025,605 A 6/1991 Sekijima et al.
(Continued)

FOREIGN PATENT DOCUMENTS

CA 2884137 A1 3/2014
CN 101772606 7/2010
(Continued)

OTHER PUBLICATIONS

Chinese Office Action and English translation.
Japanese Office Action.

*Primary Examiner* — Michael M. Robinson
*Assistant Examiner* — Victoria Bartlett
(74) *Attorney, Agent, or Firm* — Jacobson Holman PLLC

(57) ABSTRACT

Prestressed carbon fibers of at least one textile structure comprising carbon fibers are embedded in a concrete matrix. At least one textile structure comprising carbon fiber bundles is laid in a mold at a distance from one another, into two accommodation elements which are arranged at two diametrical end faces of the mold. Hollow spaces within the accommodation element are filled with a rapid-curing viscous composition having a mineral basis or rapid-curing polymer. After curing the composition or of the polymer, tensile forces act on the accommodation element(s) in the longitudinal direction of the carbon fiber bundles with a tensioning device. During the tensile force the interior of the mold is subsequently filled completely with viscous concrete. After curing of the concrete, the tensile forces on the prestressed carbon fiber bundles are largely transferred to the cured concrete and the concrete component can then be removed from the mold.

7 Claims, 4 Drawing Sheets

(51) Int. Cl.

| | |
|---|---|
| ***B28B 23/06*** | (2006.01) |
| ***E04C 5/12*** | (2006.01) |
| ***E04C 5/08*** | (2006.01) |
| ***E04C 5/07*** | (2006.01) |
| ***E04G 21/12*** | (2006.01) |

(52) U.S. Cl.
CPC ..... *E04C 5/07* (2013.01); *E04C 5/073* (2013.01); *E04C 5/085* (2013.01); *E04C 5/12* (2013.01); *E04G 21/12* (2013.01)

(56) References Cited

U.S. PATENT DOCUMENTS

| | | | | |
|---|---|---|---|---|
| 6,773,650 | B1 * | 8/2004 | Longo | B28B 15/007 425/111 |
| 2015/0267408 | A1 * | 9/2015 | Kurath-Grollmann | E04B 1/16 52/223.6 |
| 2016/0115658 | A1 * | 4/2016 | Annan | E01D 21/00 14/21 |

FOREIGN PATENT DOCUMENTS

| | | | |
|---|---|---|---|
| DE | 102004033015 | A1 | 3/2005 |
| EP | 0297006 | | 12/1988 |
| EP | 1396321 | A1 | 3/2004 |
| JP | H01316219 | | 12/1989 |
| JP | H06108657 | A | 4/1994 |
| JP | H09207117 | A | 8/1997 |
| JP | 2005155081 | A | 6/2005 |
| JP | 2015-534613 | | 12/2015 |
| WO | 2014/040653 | A1 | 3/2014 |

* cited by examiner

METHOD AND DEVICE FOR PRODUCING CONCRETE COMPONENTS

BACKGROUND OF THE INVENTION

The invention relates to a process and an apparatus for producing concrete components. It has been known for a long time that the susceptibility of concrete components to tensile forces acting on them can be countered by compressive forces which act within the concrete components and are transferred by prestressed tensile elements in the concrete to the cured concrete matrix, in the form of the prestressed concrete mode of construction. Both the mass of concrete required and also of the concreted-in reinforcement can be reduced in this way.

In the recent past, the development of concrete components in which the conventional steel reinforcement is replaced by fiber reinforcement, in particular carbon fiber reinforcement, has proceeded at a pace. Concrete components having smaller dimensions but the same stability and strength can be made available in this way. Hitherto, textile structures made of carbon fibers have merely been embedded in a concrete matrix, and the advantages achievable by means of prestressed concrete components have not been exploited to a sufficient extent. The use of prestressed rods of carbon fiber composites CFC is known from DE 10 2004 033 015 A1. However, these tensile rods functioning as tensile anchors produce a relatively locally concentrated tensile force or it is necessary to use a large number of such reinforcing rods, which in turn increases the processing complexity due to the intended individual stressing of the rods.

SUMMARY OF THE INVENTION

It is therefore an object of the invention to create possibilities for the simultaneous, uniform prestressing of many fiber bundles and achieve more uniform introduction of the prestressing forces in the concrete body, which leads to an increase in the strength and stiffness in the case of a further possible increase in the degree of prestressing, while at the same time possibly reducing the mass in the production of concrete components.

According to the invention, this object is achieved by a process and apparatus set forth in the claims.

In the process of the invention for producing concrete components in which carbon fibers of at least one textile structures made of carbon fibers which have been prestressed by means of a tensile stress are embedded in a concrete matrix, at least one textile structure which is made from carbon fiber bundles (rovings) or other fibers which can be subjected to tensile stress is laid in a mold. Only the term carbon fiber bundle will be used for this purpose in the following.

The carbon fiber bundles are inserted into two accommodation elements which are arranged on the end walls of the mold and at two diametrically opposite end faces of the mold, rest against these or can be connected to these at a distance from one another through openings, so that hollow spaces within the accommodation element are filled with a rapid-curing viscous composition having a mineral basis or a rapid-curing polymer.

After curing of the composition or the polymer, tensile forces are applied at at least one end face by means of a tensioning device in the longitudinal direction of the carbon fiber bundles at one or both accommodation element(s).

While the tensile forces are acting, the interior of the mold is completely filled with viscous concrete.

After curing of the concrete, the tensile forces are released and the concrete component is removed from the mold.

If tensile forces act only on one of the two accommodation elements, the other accommodation element is clamped firmly.

As rapid-curing composition, it is possible to use, for example, polymer concrete, and as rapid-curing polymer it is possible to use an epoxy resin as is used at present in the production of carbon fiber composites. When a polymer is used, it can be advantageous to coat interior surfaces of the accommodation elements with a release agent, e.g. with silicone oil. Composition or polymer should allow good positive locking to the accommodation elements in order to allow very uniform introduction of the tensile forces along the interior surface of the accommodation elements. The interior surface can be rough or profiled, so that the tensile forces to be introduced can be conducted more uniformly from the matrix into the walls of the accommodation elements and overstressing can be avoided, so that a shortening of the anchoring length in the accommodation elements can be achieved.

The curing of the composition or of a polymer should be concluded after not more than one hour. This time is considerably shorter, i.e. a number of hours shorter, than that required for the concrete to cure in the mold.

After curing of the matrix in the accommodation elements, the compressive forces applied by means of clamping elements or pressure punches should be increased further. The compressive forces employed for this purpose should be selected as a function of the length of the carbon fiber bundles within the accommodation elements and/or the total length of the carbon fiber bundles of the textile structure, with the compressive force being at least 10% of the longitudinal tensile forces exerted for stressing.

Subsequently, the higher tensile forces utilized for tensioning the carbon fiber bundles can act on the at least one accommodation element. These can be applied by means of a hydraulic cylinder or pneumatic cylinder, a screw drive or another linear drive. The minimum tensile force selected in each case should attain 60%-90% of the permissible tensile strength of the carbon fiber bundles. Here, the stresses taken into account for the construction of the respective concrete component should be taken into account and the strength of the carbon fibers should be exploited to a maximum.

At least the region of the textile structure which has been inserted into the accommodation elements should preferably have been impregnated with epoxide or other solutions which guarantee durable envelopment of the fibers and adhesion.

Likewise, the concrete should be introduced into the mold using tools which guarantee pore-free envelopment of the fiber bundles before the concrete cures or sets within the mold.

Particularly in the case of long molds, it can be useful to arrange spacers or positioning elements within the mold so that one or more layer(s) of a textile structure can be held in the desired position.

Compressive forces which act at least almost perpendicularly relative to the longitudinal axes of the carbon fiber bundles should advantageously be exerted on at least two diametrically opposite sides of the accommodation element, at least during filling of the hollow spaces in the accommodation element, preferably also until after the composition or the polymer has cured. Suitable pressure punches or clamping elements which act from two sides can be used for this purpose. This can also ensure that a sufficiently strong material-to-material bond can be formed between the surfaces of the carbon fibers and the composition or the polymer.

The carbon fiber bundles can be kept in position within the accommodation element by means of spacers and/or transverse clamping elements. Spacers can advantageously be oriented parallel to the longitudinal axis of the carbon fiber bundles and transverse clamping elements can be aligned perpendicular to this direction, which is particularly advantageous when carbon fiber lay-ups are used, as a particularly suitable example for a textile structure.

In the case of concrete components having a complex shape, it can be necessary to allow the compressive forces which can be achieved by means of the prestressed carbon fiber bundles to act locally defined in various axial directions. In these cases in particular, it can be advantageous for a plurality of preferably pivotally joined accommodation elements to be arranged at at least one end face of the mold, so that at these preferred tensile forces then act in various axial directions on accommodation elements and accordingly also the carbon fiber bundles in the longitudinal axis direction of the carbon fiber bundles.

In addition to the material-to-material bond between the surfaces of the carbon fibers and the cured composition or the cured polymer, a certain degree of positive locking should also be able to be achieved. For this purpose, carbon fiber bundles can be inserted in an accommodation element and/or mold which is curved relative to a plane in at least one direction and be fixed therein. The carbon fiber bundles therefore perform at least one change in direction within the accommodation element and/or mold which has been curved in this way. However, they can also be conducted in a shape which has been multiply curved by an accommodation element through an accommodation element and then be fixed appropriately there in the cured composition or the polymer.

In the case of accommodation elements which are curved in this way, compressive forces can be exerted onto the outer wall of the accommodation elements by means of appropriately contoured pressure punches or clamping elements. It is also possible to utilize a plurality of pressure punches or clamping elements which are arranged next to one another.

Carbon fiber bundles can be fixed in the openings as a result of pressure forces exerted by means of clamping elements or pressure punches. After fixing, a tensile force can be applied so as to draw the carbon fiber bundles taut. This tensile force should be significantly lower than the tensile forces which act on the accommodation elements and the carbon fiber bundles after solidification or curing of the composition or the polymer within the accommodation elements when the concrete is introduced into the mold. It serves merely to straighten the carbon fiber bundle structure.

The accommodation elements are advantageously made up of at least two parts which can be pressed against one another, which can aid the insertion and fixing of the carbon fiber bundles. Openings through which the carbon fiber bundles can be conducted are formed here. These openings can be slot-shaped and preferably be oriented perpendicularly to the direction in which the tensile forces act on the carbon fiber bundles or perpendicularly to the longitudinal axis of the carbon fiber bundles. This makes it possible to fix all carbon fiber bundles of one layer of a textile structure or one plane inserted into the respective accommodation element by means of a single slot-shaped opening. Here, the upper side and/or underside can be provided with a clamping coating.

If a plurality of layers of a textile structure are to be utilized for producing a concrete component, it is possible to select multiply divided accommodation elements each having a number of individual parts which are arranged above one another, where the number of individual parts is 1 greater than the number of layers of textile fabric.

To increase or achieve positive locking, the surfaces of carbon fibers can have a roughened surface at least in the region where they are arranged within an accommodation element. For this purpose, particles, in particular mineral particles, e.g. silica sand, can be applied to the surface of carbon fibers at least within the accommodation elements and be fixed there.

At the openings which are present at the end face of the accommodation elements facing in the direction of the mold and through which the carbon fiber bundles are inserted into the accommodation elements, there can in each case be a clamping coating composed of a preferably elastomeric material. Such a clamping coating can be utilized for gentle introduction of the carbon fiber bundles and for sealing.

After curing of the concrete in the mold, which can take from 12 hours up to 7 days, the tensile force acting on the accommodation elements and the carbon fiber bundles can be increased. After the applied force is released, the prestressed force within the concrete component can be utilized for increasing the achievable tensile strength in a manner analogous to the known prestressed concrete elements having steel elements.

Due to the prestressing of the carbon fibers within the cured concrete matrix, stressing forces in the form of compressive stresses are introduced into the concrete after cutting-off or division of the concrete component by means of a parting operation. In the case of loads occurring during use, freedom from cracks of the concrete component can be maintained. This can also be ensured in the case of concrete components which are completely or partly arched.

The total thickness of a concrete component produced according to the invention should be at least four times the thickness or the sum of the thicknesses of the layers of textile structure in order to achieve satisfactory covering of the carbon fibers of the textile structure(s) with concrete. In the case of one layer and an average thickness of a carbon fiber bundle of 1.5 mm, covering in the last layer closest to the concrete surface of 6 mm should be adhered to. Maintenance of a degree of reinforcement of at least from 0.5% to 8% of the concrete cross section should be ensured. In any case, voids within the concrete should be avoided.

In this way, it is possible to produce concrete components having a tensile or compressive strength which attains a ten times higher strength than the tensile and compressive strength of wood and is in the vicinity of the strength of steel components.

By means of one or more layers of a textile structure arranged above one another at predeterminable distances from one another and from the outer surfaces of a concrete component within the accommodation elements and the mold, which layers are embedded in the concrete, it is possible to prestress strips of a textile structure cut to length at any position for taking up temporarily applied external tensile forces on textile structures having an ordered position and direction by means of tensile forces. Concrete components produced according to the invention can utilize the stressing forces even after division of a concrete component into a plurality of individual smaller components, even when the division has been carried out at an angle other than 90° to the longitudinal axis of carbon fiber bundles.

As mentioned above, lay-ups can advantageously be used as textile structures. However, it is also possible to use woven fabrics, drawn-loop knits or formed-loop knits for this purpose.

Production according to the invention can be carried out industrially at one location or else on site, i.e. directly at a building site.

It is possible to produce concrete components which are very slender, light, stiff and dimensionally stable. The consumption of concrete can be considerably reduced, so that a mass saving of from 50% to 80% compared to corresponding steel-reinforced concrete components can be achieved at the same load-bearing capability and strength.

DESCRIPTION OF THE DRAWINGS

The invention will be illustrated by way of example below. The individual features seen and explained in the figures or examples can be combined with one another, independently of the respective figure or example.

The figures show.

DETAILED DESCRIPTION OF THE INVENTION

Figure 1:
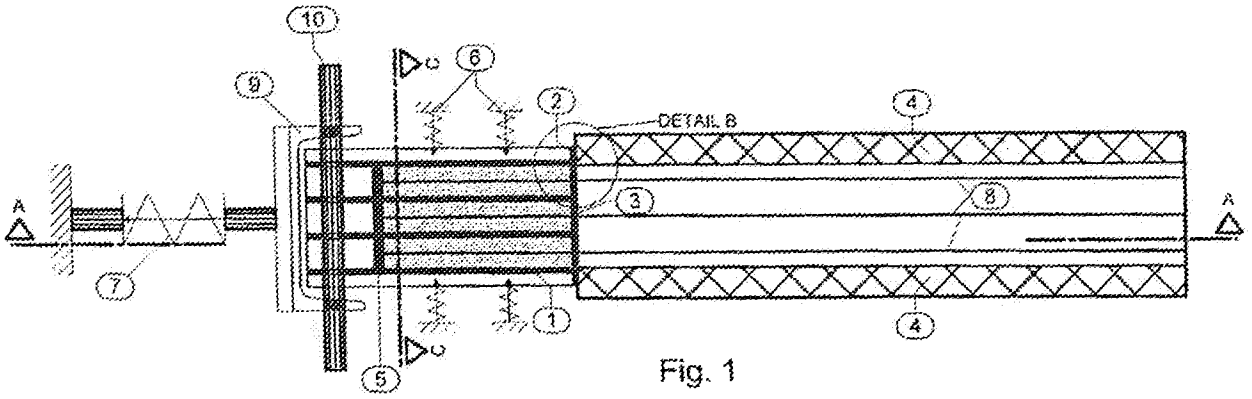
FIG. 1 an example of an apparatus according to the invention in plan view.

FIG. 1 shows a plan view of part of an example of an apparatus according to the invention. In the depiction, an accommodation element 1 is arranged at an end face of a mold 4 and rests against this end face and/or closes-off/seals the mold 4. In an analogous way, a second accommodation element 1 is present at the opposite end face, but this is not shown here.

Openings 3 are present at the end face of the accommodation element 1 which is arranged at the end face of the mold 4 and the carbon fiber bundles 8 of a lay-up made up of carbon fibers are inserted through these openings into the interior of the accommodation element 1. Spacers 5 for the carbon fiber bundles 8 of the lay-up are additionally present in the accommodation element 1. At two opposite sides of the accommodation element 1 there are transverse clamps 6 by means of which compressive forces which act on the corresponding outer walls of the accommodation element 1 can be applied.

A clamping coating composed of an elastomer is in each case present in the openings 3. The clamping coatings seal the accommodation element 1 from the interior of the mold 4 and exert a clamping action on the carbon fiber bundles 8. A slight prestressing of the carbon fiber bundles 8 within the accommodation element 1 can be achieved by means of this clamping action when the accommodation element 1 is drawn to the left here by means of a screw drive or a pressure cylinder 7.

After attainment of a particular degree of prestressing of the carbon fiber bundles 8 within the accommodation element 1, the hollow spaces can be filled with polymer concrete as viscous composition having a mineral basis in a suitable viscous consistency. After about one hour, the polymer concrete has been sufficiently cured and has a strength by means of which secure material-to-material bonding between polymer concrete and carbon fiber bundles 8 can be achieved. The carbon fiber bundles 8 can now be tensioned by drawing back the pressure cylinder 7. The interior of the mold 4 through which the carbon fiber bundles 8 of the lay-up are conducted to and into the other accommodation element 1 (not shown) can be filled completely with concrete, so that virtually no voids are formed.

Before filling of the mold 4 with the concrete, the carbon fiber bundles 8 are subjected to tensile forces by actuation of the cylinder 7. Here, the yoke-shaped element 9 and a pin 10, which can also be a flange, which are connected to the accommodation element 1 are moved in the direction pointing away from the mold 4. The tensile forces acting on the carbon fiber bundles 8 at least in the interior of the mold 4 are then, for example, in the range from 50 kN to 100 kN at a fiber cross section of 50 $mm^2$.

It can be sufficient for these prestressing forces to be applied only from one side and the compressive forces to act only at one accommodation element 1 while the other accommodation element 1 is kept fixed.

Figure 2:
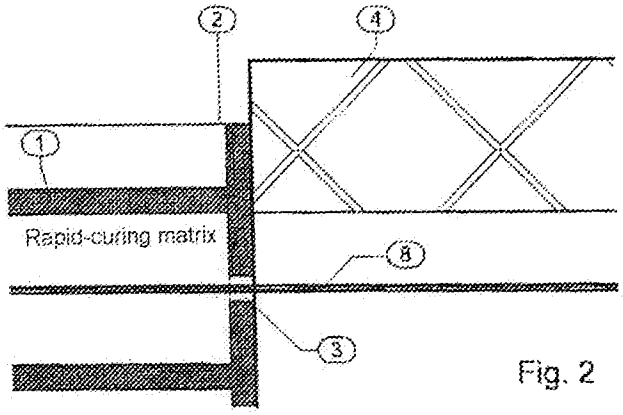
FIG. 2 a detail B from FIG. 1.

FIG. 2 shows a detail from FIG. 1 in enlarged form. The end face 2 of the accommodation element 1 closes off at the end face of the mold 4 in order to prevent concrete from flowing out of the mold at a later time. The openings 3, in which a clamping coating is present in each case, through which the carbon fiber bundles 8 are conducted through the mold 4 and from there into the interior of the accommodation element 1 are present in this end face 2. A clamping coating can, for example, consist of polyurethane. The internal diameter of the openings 3 is, in combination with the thickness of the clamping coating, made such that a free cross section which is smaller than the outer cross-sectional dimensions of the carbon fiber bundles 8 is obtained.

Figure 3:
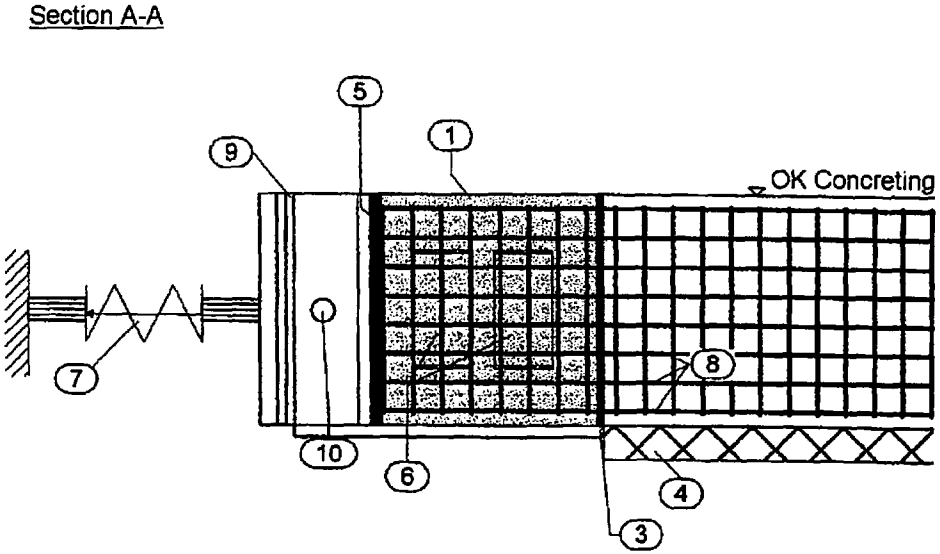
FIG. 3 the section A-A from FIG. 1.

The section A-A from FIG. 1, as shown in FIG. 3, makes it clear that spacers 5 for the carbon fiber bundles 8 of the carbon fiber lay-up, as an example of a textile structure, can be present in the interior of the accommodation element 1.

Figure 4:
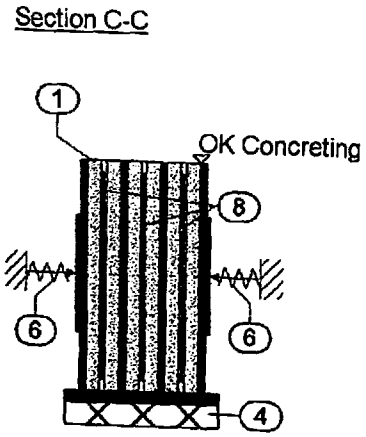
FIG. 4 the section C-C from FIG. 1.

The section C-C shown in FIG. 4 again clarifies the arrangement of transverse clamping elements 6 on the side walls of the accommodation element 1. Instead of the transverse clamping element 6, it is also possible to use pressure punches which exert force on the opposite sides of the accommodation element 1.

Figure 5:
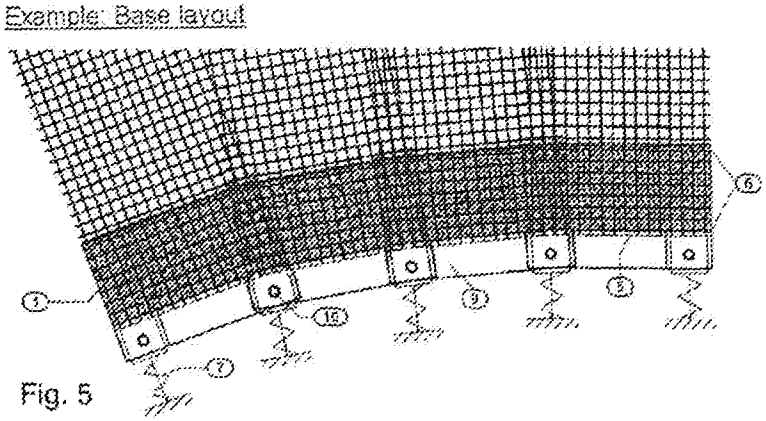
FIG. 5 an example of an apparatus in which tensile forces act in various axial directions.

FIG. 5 is intended to show that even relatively geometrically complex concrete components can be produced by means of the invention. Here, a plurality of lay-ups made of carbon fibers are present in a mold. The carbon fiber bundles 8 of these are oriented in different axial directions, so that they are prestressed by the tensile forces applied corresponding to this respective axial direction. At a yoke-shaped element 9 which is appropriately bent or kinked, the tensile forces can act in the axial direction assigned to the respective force application position corresponding to the orientation of the carbon fiber bundles 8 at various positions by means of a screw drive or a cylinder 7 when the polymer concrete has cured sufficiently in the accommodation element 1.

However, it is also possible to connect a plurality of yoke-shaped elements 9 to one another in a pivoting manner. Here, the linkages can be formed with the aid of the pin 10. The orientation of the individual yoke-shaped elements 9 then depends on the respective tensile force direction acting on a yoke-shaped element 9.

Figure 6:
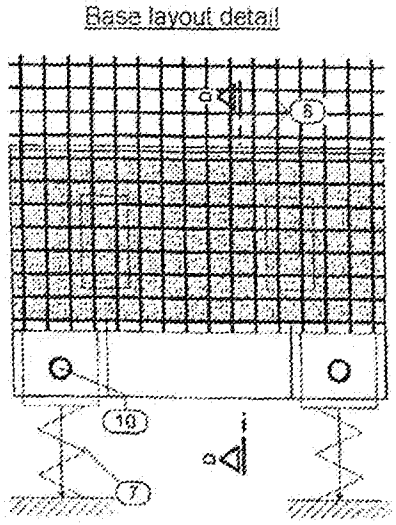
FIG. 6 a plan view of a part of an accommodation element having a gripping tensioning device.

FIG. 6 shows a plan view of part of an apparatus of the example shown in FIG. 5.

Figure 7:
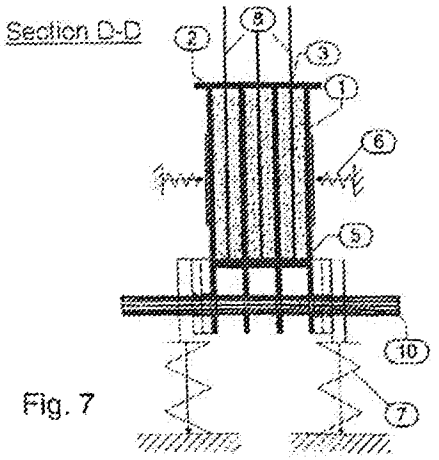
FIG. 7 a section D-D from FIG. 6.

FIG. 7 corresponds to the section D-D of FIG. 6.

Figure 9:
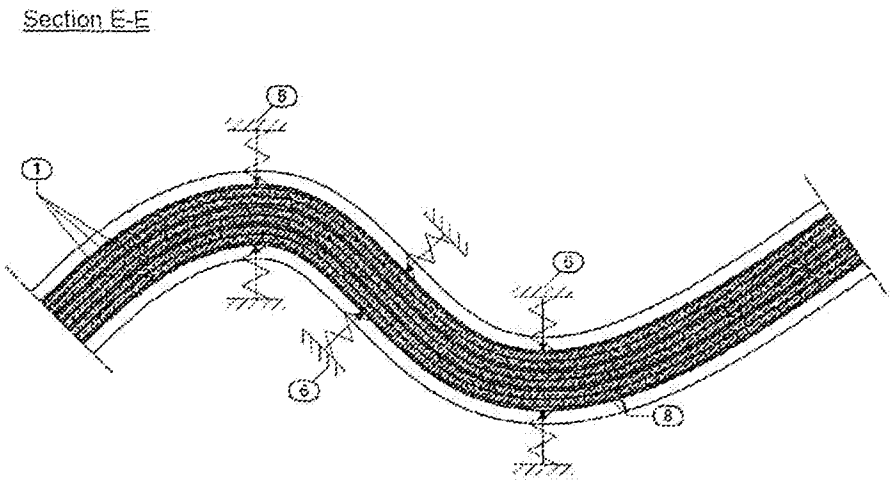
Figure 8:
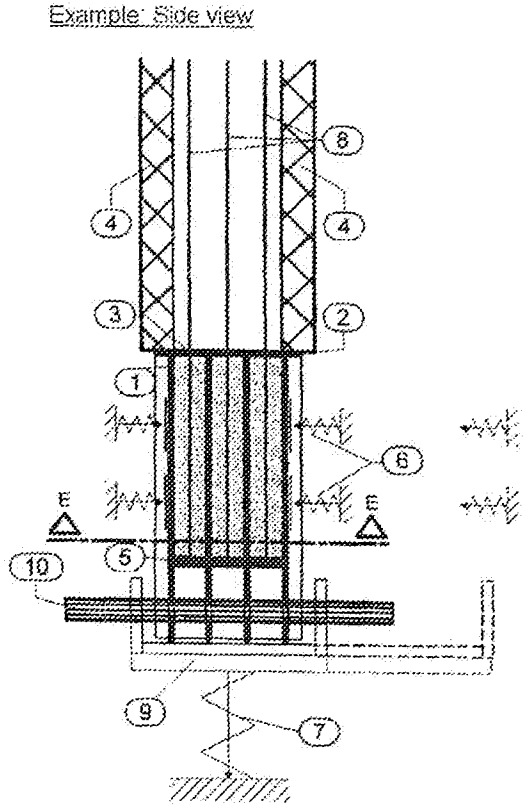
FIG. 8 a side view of a part of an example of an apparatus according to the invention and FIG. 9 the section E-E from FIG. 8.

FIG. 8 shows a cut side view of an apparatus. It can be seen from the section E-E shown in FIG. 9 that a mold 4 which has one or more curves and optionally correspondingly curved accommodation element(s) 1 can be used and it is in this way possible to produce a wavy or otherwise curved concrete component in which the carbon fiber bundles 8 are embedded in prestressed form in the concrete. Here, a plurality of transverse clamps 6 are arranged along the mold 4 and the accommodation elements 1 so that compressive forces can be exerted from two opposite sides.

The invention claimed is:

1. A process for producing concrete components in which carbon fibers prestressed by means of tensile stress or tensile-stressable fibers of at least one textile structure made of carbon fibers are embedded in a concrete matrix;

placing at least one textile structure comprising carbon fiber bundles in a mold;

inserting the carbon fiber bundles at a distance from one another, into two accommodation elements which are arranged at two diametric end faces of the mold and are arranged on, supported on or connectable to the end walls of the mold through openings; filling hollow spaces within the accommodation elements with a rapid-curing viscous composition having a mineral basis or a rapid-curing polymer;

curing the viscous composition or the rapid-curing polymer to securely fix the carbon fiber bundles and applying tensile forces in a longitudinal direction of the carbon fiber bundles on one or both accommodation element(s) at at least one end face to prestress the carbon fiber bundles and during the application of the tensile forces the mold is completely filled with viscous concrete;

curing the concrete in the mold and the tensile forces for the prestressed carbon fiber bundles are transferred to the cured concrete; exerting external compressive forces to at least two diametrically opposite sides to the accommodation element perpendicular to the longitudinal direction of the carbon fiber bundles until after curing of the viscous composition and the concrete; and the concrete is then removed from the mold.

2. The process as claimed in claim 1, wherein the compressive forces are increased further after curing the concrete.

3. The process as claimed in claim 1, wherein the carbon fiber bundles are kept in position within the accommodation elements by means of spacers or transverse clamping elements.

4. The process as claimed in claim 1, wherein carbon fibers are laid up in the mold.

5. The process as claimed in claim 1, wherein a plurality of accommodation elements which are connected to one another in a pivotable manner and on which tensile forces acting in different axial directions are arranged at at least one end face of the mold.

6. The process as claimed in claim 1, wherein the carbon fiber bundles are inserted into an accommodation element which is curved in at least one direction relative to a plane and the carbon fiber bundles are fixed therein.

7. The process as claimed in claim 1, wherein silica sand is applied to surfaces of the carbon fibers within the accommodation elements and fixed there.

* * * * *